United States Patent [19]

Schell

[11] 4,349,391

[45] Sep. 14, 1982

[54] PROCESS FOR PRESERVING PLANOGRAPHIC PRINTING FORMS

[75] Inventor: Loni Schell, Hofheim, Fed. Rep. of Germany

[73] Assignee: Hoechst Aktiengesellschaft, Fed. Rep. of Germany

[21] Appl. No.: 235,541

[22] Filed: Feb. 18, 1981

[30] Foreign Application Priority Data

Feb. 19, 1980 [DE] Fed. Rep. of Germany ..... 3006094

[51] Int. Cl.[3] ..... B41M 5/00

[52] U.S. Cl. ..... 148/6.15 R; 148/6.27; 430/302; 430/309

[58] Field of Search ..... 148/6.27, 6.15 R; 430/309, 302; 101/451, 456, 457, 463.1, 465

[56] References Cited

U.S. PATENT DOCUMENTS 3,900,370 8/1975 Germscheid et al. ..... 148/6.15 R
4,033,919 7/1977 Lawson ..... 101/451

FOREIGN PATENT DOCUMENTS 2659754 7/1978 Fed. Rep. of Germany .
1495522 12/1977 United Kingdom .
1542800 3/1979 United Kingdom .

*Primary Examiner*—Ralph S. Kendall
*Attorney, Agent, or Firm*—James E. Bryan

[57] ABSTRACT

This invention relates to an improved process for preserving a planographic printing form which is ready for printing. In the process, the planographic printing form is treated with an aqueous solution of a water-soluble, film-forming high-molecular weight organic compound and a hydrophilizing acid and is then dried. The hydrophilizing acid used is an organic phosphonic acid, in particular polyvinyl phosphonic acid, preferably in a concentration from 0.05 to 10 percent by weight. As the water-soluble, high-molecular weight organic compound gum arabic, dextrin or polyvinyl alcohol is appropriately used.

3 Claims, No Drawings

PROCESS FOR PRESERVING PLANOGRAPHIC PRINTING FORMS

The present invention relates to a process for preserving planographic printing forms which are developed and ready for printing, in order to protect these printing forms against the access of air and contamination during storage before being used in printing and, at the same time, render their non-printing surface areas permanently hydrophilic.

As is known, planographic printing plates which are ready for printing must be subjected to such a protective treatment prior to any prolonged storage. An aqueous gum arabic solution is very widely used for this treatment, but it is also known to employ dextrin solutions.

German Offenlegungsschrift No. 2,659,754 discloses the use of aqueous polyvinyl alcohol solutions for the same purpose.

From German Offenlegungsschrift No. 2,504,594, it is further known to combine acrylamide polymers containing carboxyl groups with acids, particularly with phosphoric acid, for use as hydrophilizing agents and for the preservation of printing forms.

The effect achieved by the customary preserving agents is normally sufficient for many support materials. It became apparent, however, that this subsequently applied protective film does not always suffice to prevent the occurrence of scumming in the printing procedure. In the case of printing forms the support material of which is composed of anodically oxidized aluminum, particular care generally must be taken to prevent an oleophilic contamination of the support surface exposed by development, for example, contamination by dust or dirt particles or by finger marks, before the plate is subjected to the preserving treatment, because it is, as a rule, difficult to remove such contaminations without thereby attacking the printing layer or the support surface. Contaminations of that kind easily may get onto the plate in the time between development and preservation, and also during development or even in the preparation of a wipe-on printing plate.

It is therefore an object of the present invention to provide a preserving process by which the image-background of planographic printing plates can be protected against subsequent contamination and which, in addition, makes it possible to free the plates from an already existing minor oleophilic contamination.

The subject of the invention is a process for preserving planographic printing forms which are ready for printing, in which the planographic printing form is treated with an aqueous solution of a water-soluble, film-forming, high-molecular weight organic compound and a hydrophilizing acid, and is then dried.

In the process of the invention, an organic phosphonic acid is used as the hydrophilizing acid.

The invention makes it possible to obtain a clean, scum-free background in printing, even if, on the plate, this background was already affected by an oleophilic contamination before carrying out the preserving treatment.

Suitable organic phosphonic acids include aromatic, heterocyclic, aliphatic and cycloaliphatic, low-molecular weight and high-molecular weight phosphonic acids and the derivatives thereof.

These include, for example, vinyl phosphonic acid, polyvinyl phosphonic acid, 2-phosphono-ethane-1-sulfonic acid, 3,3-diphosphono-pimelic acid, vinyl phosphonic acid monomethyl ester, 4-chlorophenyl phosphonic acid, 4-chloro-3-nitro-phenyl phosphonic acid, β-styryl phosphonic acid and water-soluble copolymers or vinyl phosphonic acid with acrylic acid and/or vinyl acetate. Of these, polyvinyl phosphonic acid is particularly preferred.

The concentration of phosphonic acid in the preserving solution usually ranges between 0.05 and 10, preferably between 0.1 and 5% by weight.

As the water-soluble, film-forming, high-molecular weight organic compounds, any of the substances are in principle suitable which are conventionally employed as the constituents of preserving solutions for planographic printing forms. Gum arabic, dextrins, and polyvinyl alcohol are, for example, suitable. The high-molecular weight compounds are generally present in a concentration ranging between 4 and 40, preferably between 5 and 35% by weight.

The preserving solution can be applied to the plate surface by rubbing on by hand, by immersion into a bath or by roller application, spraying or the like in a processing machine. The plate is then dried.

In general, the support materials of the printing forms to be treated are composed of aluminum and, especially, the well-known and preferred support materials with improved surfaces are used, for example aluminum which is mechanically, chemically or electrochemically roughened and optionally treated with alkali silicates, polymeric acids and other agents known in the art. The solution according to the invention is particularly suitable for the treatment of printing plates the supports of which comprise anodically oxidized aluminum, wherein the oxide layer also may have been pretreated with the above-specified agents, e.g. with silicates.

The printing image areas of the printing form may be produced by any known method. As a rule, a photosensitive layer is exposed to light and is then developed with a developer solution. The image also may be generated in an electrophotographic process by charging, exposing to light, applying toner to and fixing a photoconductive layer. In any case, the nature of the support surface which has been exposed by development and which is to be rendered hydrophilic is of greater importance to the effectiveness of the treating solution than the nature of the printing layer and the method of producing the printing layer. The preferred photosensitive layers are those which are normally used for planographc printing and which are based on positive-acting or negative-acting diazo compounds, azido compounds, photocross-linkable polymers or photopolymerizable systems, and also the photoconductive layers based on organic photoconductors and binders.

Appropriate positive-acting photosensitive layers may contain o-quinone diazides or combinations of photolytic acid formers and acid-cleavable acetal compounds or orthocarboxylic acid compounds as the photosensitive constituents. Such layers preferably include binders which are insoluble in water and soluble in aqueous-alkaline solutions, for example, phenolic resins. Suitable layers are described in German Pat. Nos. 938,233, 1,195,166, and 2,610,842, and in German Offenlegungsschriften Nos. 2,331,377, 2,742,631, 2,828,037, 2,718,254 and 2,928,636.

The preferred negative-acting layers are those which are based on diazonium salt condensation products, p-quinone diazides or photopolymerizable mixtures. Suitable substances of that kind are described in the following publications: German Pat. Nos. 1,104,824, 1,134,093, 1,214,086, and 2,027,467 and German Offenlegungsschriften Nos. 2,024,244, 2,034,655, 2,739,774, and 2,822,887.

As the photoconductors, organic photoconductors are preferably used, for example, of the kind disclosed in German Pat. No. 1,120,875 or in German Auslegeschrift No. 2,526,720. The binders contained in the photoconductive layer are preferably insoluble in water and soluble in aqueous-alkaline solutions. Copolymers which contain carboxyl groups are particularly preferred. The manufacture of suitable electrophotographic materials and the processing of these materials into printing forms are described in the above-cited publications.

Preferred embodiments of the process of the invention are explained in the Examples which follow. Unless otherwise specified, percentages and ratios given in the examples denote units by weight. Parts by weight (p.b.w.) and parts by volume (p.b.v.) have the same relationship as the g to the ml.

EXAMPLE 1

An electrochemically roughened and anodized aluminum foil was coated with a solution of 2.17 p.b.w. of naphthoquinone-(1,2)-diazide-(2)-4-sulfonic acid-4-(α,α-dimethyl-benzyl)-phenyl ester,
1.02 p.b.w. of the esterification product of 1 mole of 2,2'-dihydroxy-dinaphthyl-(1,1')-methane and 2 moles of naphthoquinone-(1,2)-diazide-(2)-5-sulfonic acid choride,
0.37 p.b.w. of naphthoquinone-(1,2)-diazide-(2)-4-sulfonic acid chloride,
0.10 p.b.w. of Crystal Violet, and
9.90 p.b.w. of a cresol-formaldehyde-novolak having a softening range of 112°–118° C. in
43 p.b.v. of tetrahydrofuran,
34 p.b.v. of ethylene glycol monomethyl ether, and
9 p.b.v. of butyl acetate and was then dried. The photosensitive material obtained was exposed to light under a step-wedge with 21 steps and density increments of 0.15, in such a way that step 9 was fully blackened. The material was developed with a 5% sodium metasilicate solution.

Then the plate was wiped over with a solution of the following composition:

16 p.b.w. of polyvinyl alcohol having a viscosity of 4 mPa·s in a 4% aqueous solution at 20° C. and a residual acetyl content of 10.7%,
14 p.b.w. of yellow potato dextrin (completely soluble in water, Ostwald viscosity=2.80 at 20° C., in a 4% aqueous solution; pH value 2.8), and
9 p.b.w. of polyvinyl phosphonic acid in
261 p.b.w. of water and was dried. The layer thus applied had a weight of approximately 1 g/m². When used on a printing machine, the printing plate yielded scum-free impressions, even if an oleophilic contamination previously had been present on the dry plate.

EXAMPLE 2

An aluminum foil which had been roughened by brushing with an abrasive suspension was immersed for one minute in a bath of 0.3% of polyvinyl phosphonic acid in water at 60° C. After drying, the foil was coated with a solution of 0.7 p.b.w. of a polycondensation product prepared from 1 mole of 3-methoxy-diphenylamine-4-diazonium sulfate and 1 mole of 4,4'-bis-methoxy methyl diphenyl ether in an 85% phosphoric acid, isolated as mesitylene sulfonate,
3.4 p.b.w. of an 85% phosphoric acid, and
3.0 p.b.w. of the reaction product obtained by reacting an epoxy resin having a melting point of 70° C. and an epoxy equivalent weight of 459 with hydrochloric acid in ethylene glycol (cf. German Offenlegungsschrift No. 2,034,654) in
60.0 p.b.w. of ethylene glycol monomethyl ether,
20.0 p.b.w. of tetrahydrofuran,
10.0 p.b.w. of dimethyl formamide and
10.0 p.b.w. of butyl acetate and was then dried. The photosensitive material obtained was imagewise exposed and developed with a solution of 6.5 p.b.w. of $MgSO_4.7H_2O$ and
0.7 p.b.w. of a non-ionic wetting agent (fatty alcohol-($C_{12}$–$C_{14}$)-polyglycol ether) in
65 p.b.w. of water and
35 p.b.v. of n-propanol.

The finished plate was then wiped over with a solution of 15 p.b.w. of gum arabic and
5 p.b.w. of vinyl phosphonic acid in
80 p.b.w. of water and dried. The impressions obtained were scum-free, even if the plate was handled with moist, unclean hands.

A similar result was obtained when the support material used consisted of electrochemically roughened and anodically oxidized aluminum which, as for the rest, had been treated as described above.

EXAMPLE 3

A solution of 40 p.b.w. of 2-vinyl-4-(2'-chlorophenyl)-5-(4''-diethylaminophenyl)-oxazole,
47 p.b.w. of a copolymer of styrene and maleic anhydride having an average molecular weight of 20,000 and an acid number of 180,
10 p.b.w. of a chlorinated rubber and
0.2 p.b.w. of Rhodamine FB (C.I. 45 170) in
510 p.b.w. of tetrahydrofuran,
330 p.b.w. of ethylene glycol monomethyl ether and
150 p.b.w. of butyl acetate was applied to a 300 μm thick support consisting of electrolytically roughened and anodically oxidized aluminum and dried to give a uniform photoconductive layer having a weight of 5 g/m².

The plate was charged to about −450 V with the aid of a corona and imagewise exposed for 25 seconds in a repro-camera using 8 commercial lamps of 500 W each.

The resulting charge image was developed with a toner powder composed of 18 p.b.w. of a copolymer of 35% of n-butyl methacrylate and 65 % of styrene and
2 p.b.w. of a carbon black pigment and the toner image was fixed by heating for a short time to about 170° to 180° C. In the non-image areas the photoconductive layer was removed by treating with a solution of 12 p.b.w. of diethylene glycol monoethyl ether,
10 p.b.w. of n-propanol,
1.4 p.b.w. of sodium metasilicate-nonahydrate and
76.6 p.b.w. of water and rinsing with water.

After wiping over with a doctor blade, the plate was preserved by uniformly coating it with a solution of 10 p.b.w. of tapioca dextrin,
1 p.b.w. of glycerol,
0.3 p.b.w. of phosphoric acid (85%),
2.5 p.b.w. of sodium-n-octyl sulfate and
0.5 p.b.w. of polyvinyl phosphonic acid in
85.7 p.b.w. of water
and drying.

The printing form thus obtained yielded scum-free impressions, even if the background had been soiled by finger marks or otherwise, prior to or after the preserving treatment.

Similar results were obtained when 5 parts by weight of 3,3-diphosphono-pimelic acid were used in the preserving solution, in lieu of 0.5 part by weight of polyvinyl phosphonic acid.

EXAMPLE 4

An electrolytically roughened and anodized aluminum foil was coated with the following solution and then dried:

1.4 p.b.w. of a polyester (Desmophen 850 ® of Bayer AG), the free OH groups of which are esterified with acrylic acid,
1.4 p.b.w. of a copolymer of methyl methacrylate and methacrylic acid having an average molecular weight of 60,000 and an acid number of 93.7,
0.1 p.b.w. of 9-phenyl acridine,
0.2 p.b.w. of 1,6-dihydroxyethoxy hexane,
0.02 p.b.w. of Supranol Blue G1 (C.I. 50 335), and
13.0 p.b.w. of ethylene glycol monomethyl ether.

The photopolymerizable layer was imagewise exposed to light and developed with a solution of 15 p.b.w. of sodium metasilicate,
3 p.b.w. of polyglycol 6000,
0.6 p.b.w. of levulinic acid and
0.3 p.b.w. of strontium hydroxide octahydrate in
1000 p.b.w. of water.

The preserving solution specified in Example 1 was then applied to the finished printing plate and dried. Also in this case, good results were obtained.

It will be obvious to those skilled in the art that many modifications may be made within the scope of the present invention without departing from the spirit thereof, and the invention includes all such modifications.

What is claimed is:

1. A process for preserving a planographic printing form which is ready for printing and which is produced from a printing plate comprising mechanically, chemically or electrochemically roughened aluminum as a support material having a photosensitive layer or a photoconductive layer thereon, by treating said planographic printing form with an aqueous solution comprising (a) about 4 to 40 percent by weight of a water-soluble, film-forming, high-molecular weight organic compound selected from the group consisting of gum arabic, dextrin and polyvinyl alcohol and about 0.05 to 10 percent by weight of an organic phosphonic acid, as a hydrophilizing acid, and drying it.

2. A process as claimed in claim 1, wherein the organic phosphonic acid is polyvinyl phosphonic acid.

3. A process as claimed in claim 1 wherein said support material comprises anodically oxidized aluminum.

* * * * *